US008632445B2

(12) United States Patent
Kim et al.

(10) Patent No.: US 8,632,445 B2
(45) Date of Patent: Jan. 21, 2014

(54) MULTI-PURPOSE EXERCISE APPARATUS

(76) Inventors: Ki-Soo Kim, Gwangju-si (KR); Young-Sook Kim, Pohang-si (KR)

( * ) Notice: Subject to any disclaimer, the term of this patent is extended or adjusted under 35 U.S.C. 154(b) by 212 days.

(21) Appl. No.: 13/144,055

(22) PCT Filed: Jul. 28, 2009

(86) PCT No.: PCT/KR2009/004197

§ 371 (c)(1),
(2), (4) Date: Jul. 11, 2011

(87) PCT Pub. No.: WO2010/104248

PCT Pub. Date: Sep. 16, 2010

(65) Prior Publication Data

US 2011/0269605 A1 Nov. 3, 2011

(30) Foreign Application Priority Data

Mar. 9, 2009 (KR) ..... 20-2009-0002646

(51) Int. Cl.
*A63B 26/00* (2006.01)
*A63B 22/00* (2006.01)
*A63B 22/14* (2006.01)

(52) U.S. Cl.
USPC ..... 482/142; 482/51; 482/140; 482/146

(58) Field of Classification Search
USPC ..... 482/23, 51–52, 66, 79, 92–96, 482/121–123, 131–136, 140–142, 482/146–147; 446/431, 440, 465, 470; 280/87.01, 87.021; 128/845
See application file for complete search history.

(56) References Cited

U.S. PATENT DOCUMENTS

| | | | | |
|---|---|---|---|---|
| 5,330,399 | A * | 7/1994 | Fan | 482/34 |
| 6,945,919 | B2 | 9/2005 | Yang | |
| 7,097,602 | B1 * | 8/2006 | Kim | 482/140 |
| 7,563,216 | B1 * | 7/2009 | Kest | 482/141 |
| 2005/0187074 | A1 * | 8/2005 | Barr | 482/79 |
| 2006/0040808 | A1 * | 2/2006 | Riazi | 482/141 |
| 2007/0197360 | A1 * | 8/2007 | Rester et al. | 482/907 |

FOREIGN PATENT DOCUMENTS

| | | | |
|---|---|---|---|
| KR | 20-1992-0017736 | U | 10/1992 |
| KR | 20-0261714 | Y1 | 1/2002 |

* cited by examiner

*Primary Examiner* — Loan Thanh
*Assistant Examiner* — Jennifer M Deichl
(74) *Attorney, Agent, or Firm* — Sherr & Jiang, PLLC

(57) ABSTRACT

The present invention relates to a multipurpose exercise apparatus. More specifically, the multipurpose exercise apparatus is configured so that various kinds of exercise can be done by turning a crescent-shaped main body up and down according to the kind of exercise desire by a user, and by stepping on the main body to mount thereon or sitting down thereon, thereby allowing exercise to be enjoyed regardless of place or time and to even be enjoyed outdoors in addition to indoors and the efficiency of exercise can be maximized even with simple exercise movements. The present invention is characterized in that it has a plate shape, and it comprises a main body (100), wherein a convex surface (10) is formed at the upper part, a concave surface (20) is formed at the lower part, a handle groove (12) is provided at both the terminal parts descending along the curvature of the convex surface (10), and a supporting protrusion (22) is integrally projected at the lower part of the handle groove (12) so as to allow the main body to be separated by a certain distance from the ground; and a handle (200) which is installed on one side of the upper convex surface (10) of the main body (100) and can be attached thereto or detached therefrom.

10 Claims, 9 Drawing Sheets

MULTI-PURPOSE EXERCISE APPARATUS

TECHNICAL FIELD

The present invention relates to a multi-purpose exercise apparatus, and more particularly, to a multi-purpose exercise apparatus that enables a user to do exercise regardless of space or time outdoors as well as indoors and increases ease of use and efficiency of exercise, by allowing the user to turn over a main body of the multi-purpose exercise apparatus according to the type of desired exercise and do various kinds of exercise while stepping or sitting on the main body thereof.

BACKGROUND ART

For healthy life, many people who are pressed for time due to a busy schedule do exercise at places such as a fitness club in their spare time before and after their working hours. On the other hand, people who do not have time to do exercise at such a place have to buy a multi-purpose exercise apparatus for exercise at home.

However, when doing exercise at places like a fitness club, people have to bear an expensive membership fee. This makes people hesitate to use such a place.

Also, although exercise for the whole body can be done by an exercise apparatus such as cycling machine, chest expander, and leg press machine that is included in a multi-purpose exercise apparatus, the cost for purchasing the exercise apparatuses is expensive, and a huge area is occupied by such exercise apparatuses. In such case, doing exercise using exercise apparatuses at home may be inefficient in space utilization, and may cause a person at downstairs to complain noise thereby generated.

Most modern people such as employees or students using computers for a long time in a sitting posture and women wearing high heels may be exposed to various diseases such as disc-related diseases caused by deformation such as bending of the vertebrae and asymmetry of the pelvis that are caused by improper sitting habits.

DETAILED DESCRIPTION

Technical Problems

The present invention seeks to solve the above-mentioned problems, and provides a multi-purpose exercise apparatus for a user who does not have time to do exercise for health due to a busy schedule, which enables the user to do exercise of the whole body regardless of time and space at home without doing exercise in a place such as fitness club including exercise apparatuses at a high cost.

The present invention also provides a multi-purpose exercise apparatus that can be used outdoors as well as indoors and can be utilized as an amusement ride according to needs of a user.

Technical Solutions

To achieve the above-mentioned objectives, the present invention provides multi-purpose exercise apparatuses including: a main body having a crescent profile, the main body having a convex surface on an upper portion thereof and a concave surface on a lower portion thereof, and including grip grooves at both sides thereof, respectively, and support protrusions integrally formed under the grip grooves to be spaced apart from the ground by a certain distance; and a grip detachably disposed at one side of the convex surface of the main body.

The main body has a plurality of receiving holes for receiving pivotably-retractable wheels at edge portions of the concave surface, and the pivotably-retractable wheels are pivoted into the receiving hole on a hinge or are extended outwards.

The main body includes side plates that are integrally disposed at both sides of the main body, respectively, and each of the side plates has a shape corresponding to curvatures of the convex surface and the concave surface and has a side grip hole that is integrally formed at an inner side of the side plate.

The main body has at least one fixing hole at both sides of the convex surface thereof to allow a grip to be detachably coupled thereto.

The main body has a plurality of coupling holes penetrating the convex surface and the concave surface of the main body at side portions thereof, and the plurality of coupling holes are detachably coupled with elastic wires formed of an elastic material of excellent elastic resilience.

The multi-purpose exercise apparatus further includes a plurality of support rails disposed in the longitudinal direction on the convex surface of the main body. The plurality of support rails are spaced apart from each other by a certain distance and being integrally protruded from the convex surface of the main body.

The multi-purpose exercise apparatus further includes friction pads on the support protrusions to prevent sliding of the main body on the ground and reduce a shock during exercise.

The multi-purpose exercise apparatus further includes an elastic body detachably coupled to the fixing hole. The elastic body is partially protruded from the fixing hole to prevent the main body from inclining beyond a certain angle when a user does stepper exercise using the convex surface, and is formed of an elastic material capable of absorbing a shock for safety of a user and adjustment of exercise intensity.

The multi-purpose exercise apparatus further includes stopping protrusions integrally formed in the receiving holes to allow the pivotably-retractable wheels to be elastically fixed when the pivotably-retractable wheels extend outwards, and stopping holes formed in the pivotably-retractable wheels to allow the stopping protrusions to be coupled to the stopping holes.

The multi-purpose exercise apparatus further includes a rotation disc at the center of the concave surface of the main body to allow a user to step or sit thereon for exercise of the upper part of the body.

The multi-purpose exercise apparatus further includes a plurality of acupressure protrusions for performing an acupressure treatment on the feet of a user and a plurality of acupressure magnet protrusions for performing the acupressure treatment and promoting blood circulation, disposed on the concave surface of the main body.

Advantageous Effects

As described above, the multi-purpose exercise apparatus according to the present invention enables a user who does not have time to do exercise for health due to a busy schedule for exercise of the whole body regardless of time and space at home without doing exercise in a place such as fitness club including exercise apparatuses at a high cost.

Also, since a multi-purpose exercise apparatus according to an embodiment of the present invention can roll on the ground via pivotably-retractable wheels, the multi-purpose exercise apparatus can be used as an amusement ride by allowing one user to be seated on a main body thereof and the other user to tow the main body thereof with a tow line connected to the main body thereof.

BEST MODES FOR PRACTICING INVENTION

Figure 1:
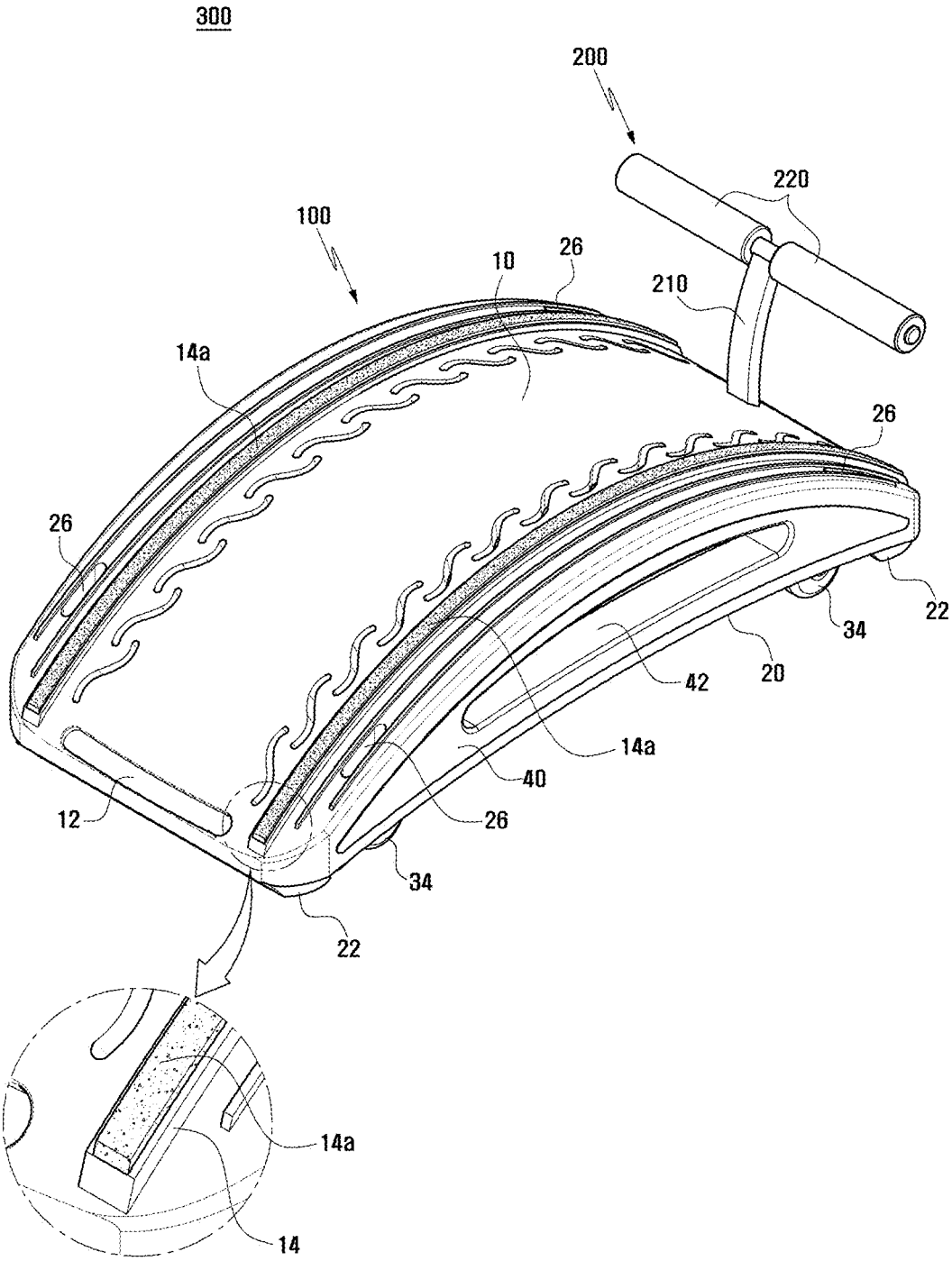
FIG. 1 is a perspective view illustrating a multi-purpose exercise apparatus according to an embodiment of the present invention.

The present invention relates to a multi-purpose exercise apparatus. More particularly, the present invention relates to a multi-purpose exercise apparatus that enables a user to do exercise regardless of space or time outdoors as well as indoors and increases ease of use and efficiency of exercise, by allowing the user to turn over a main body of the multi-purpose exercise apparatus according to the type of desired exercise and do various kinds of exercise while stepping on or sitting on the main body thereof.

The multi-purpose exercise apparatus is formed of two plates. An upper plate forms a convex surface 10, and the lower plate forms a concave surface 20. Grip grooves 12 are provided at both end portions of the convex surface 10, respectively. The multi-purpose exercise apparatus has a main body 100 and a grip 200. The main body includes support protrusions 22 integrally formed under the grip grooves 12. The grip 200 is detachably installed at one side of the convex surface 10 of the main body 100.

Hereinafter, exemplary embodiments of the present invention will be described in detail with reference to the accompanying drawings.

Figure 2:
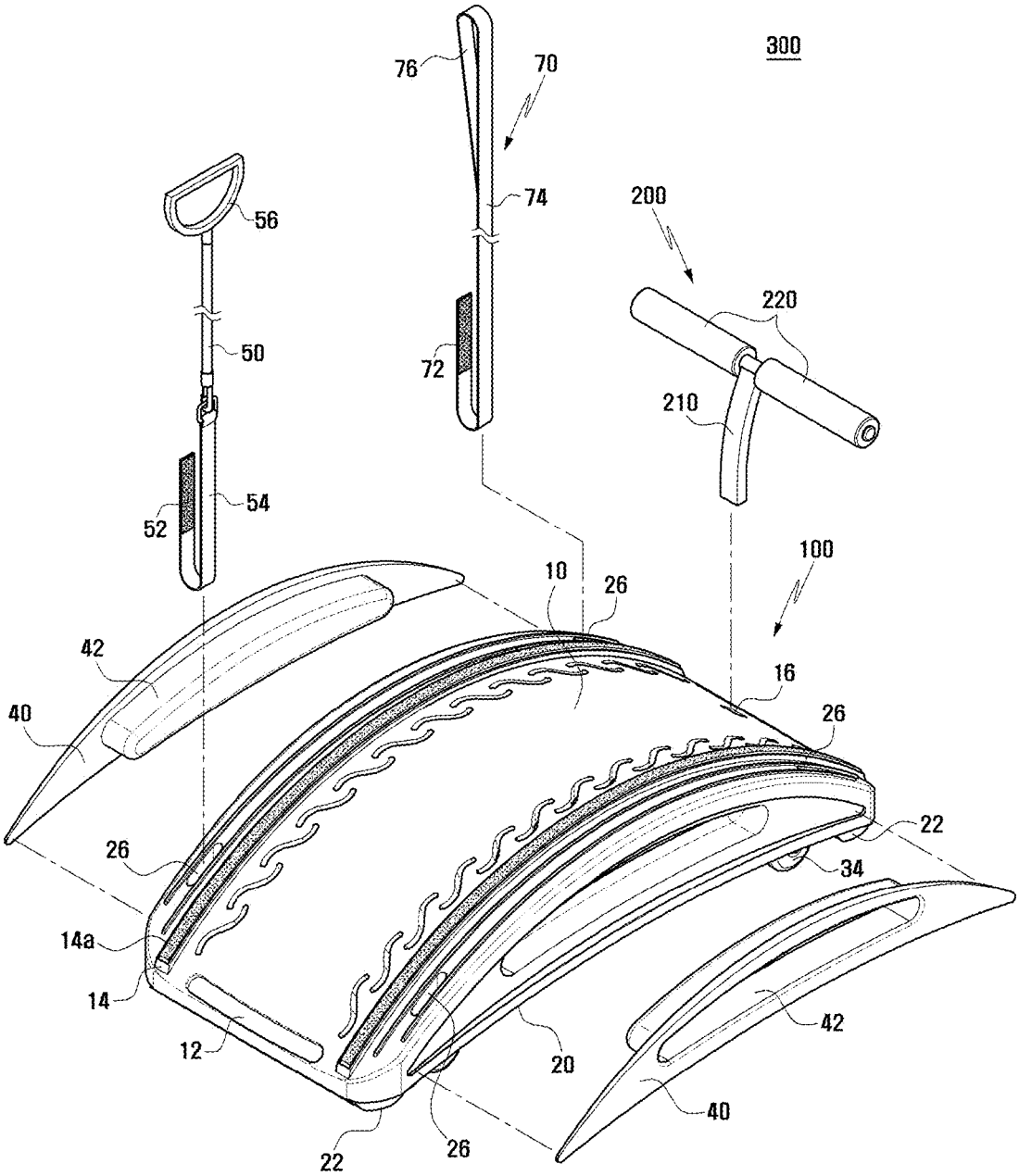
FIG. 2 is an exploded perspective view illustrating a multi-purpose exercise apparatus according to an embodiment of the present invention.
Figure 3:
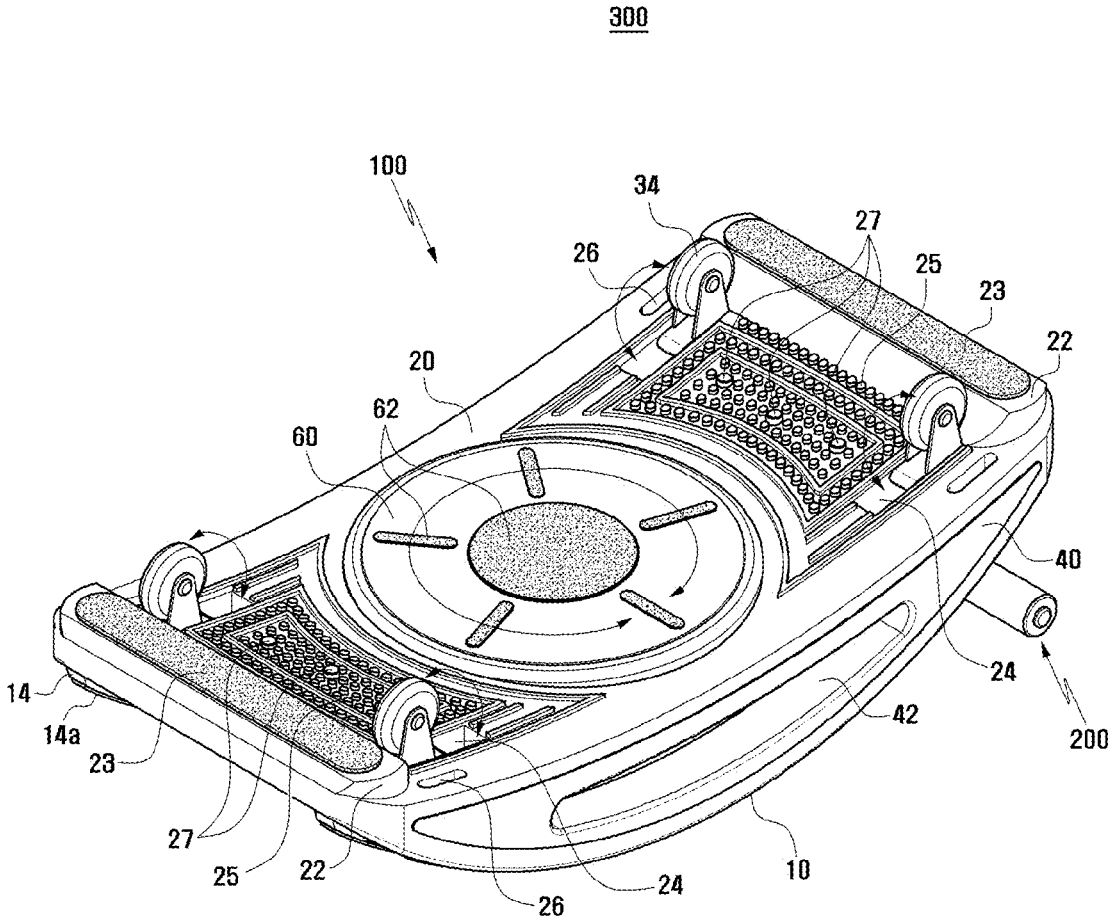
FIG. 3 is a rear perspective view illustrating a multi-purpose exercise apparatus according to an embodiment of the present invention.
Figure 4:
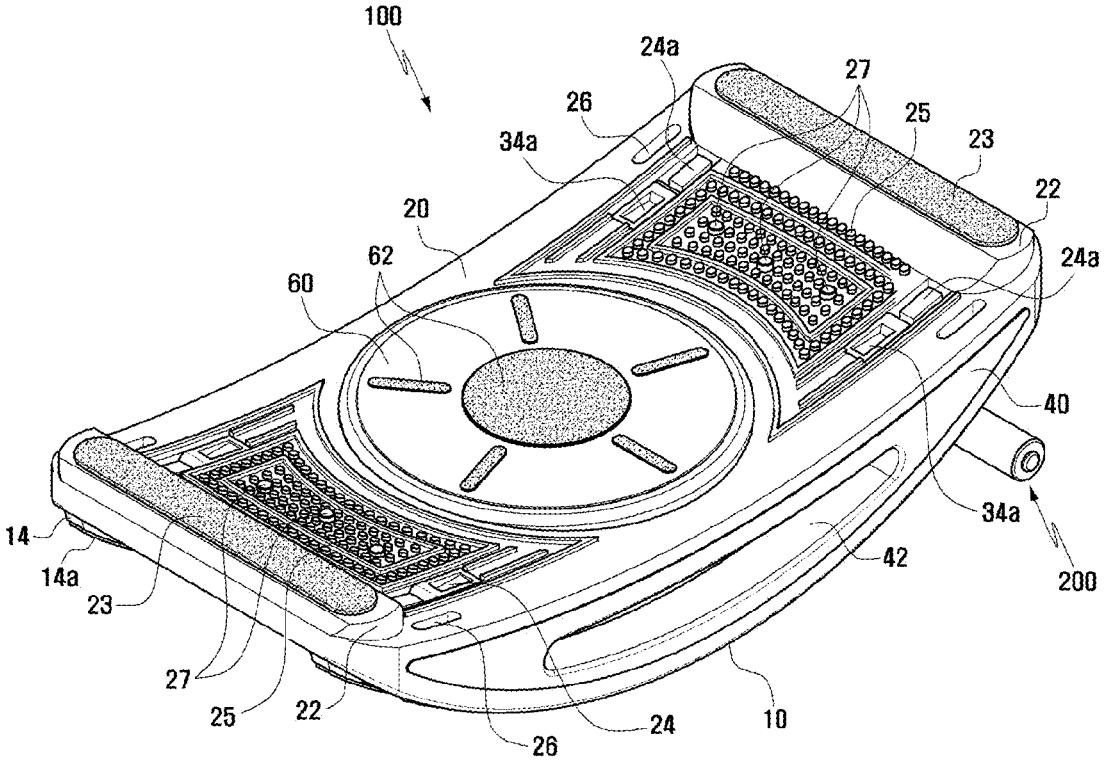
FIG. 4 is a rear perspective view illustrating pivotably-retractable wheels retracted in a multi-purpose exercise apparatus according to an embodiment of the present invention.
Figure 5:
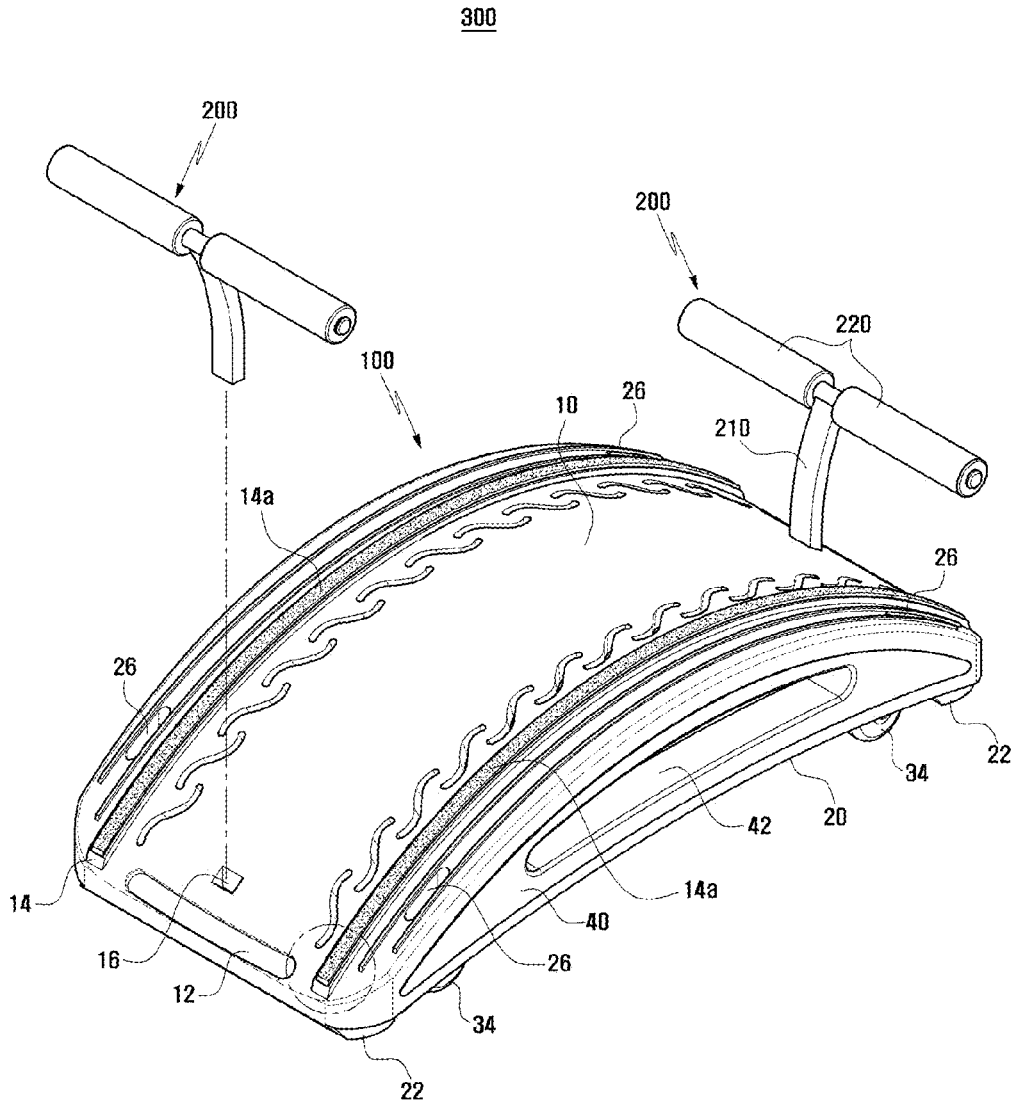
FIG. 5 is an exploded perspective view illustrating a plurality of grips of a multi-purpose exercise apparatus according to an embodiment of the present invention.
Figure 6:
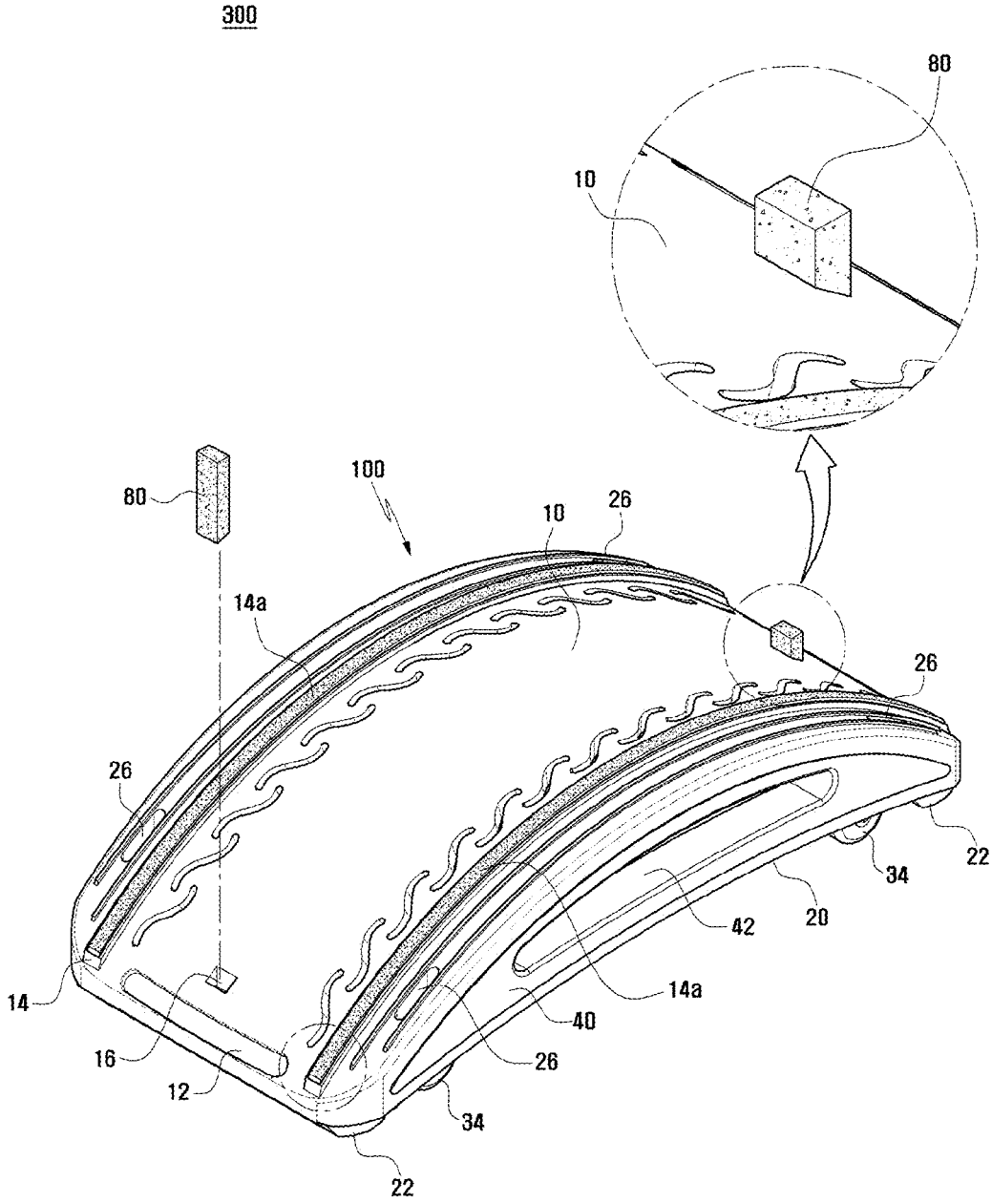
FIG. 6 is an exploded perspective view illustrating an elastic stopper detachably inserted into a fixing hole of a multi-purpose exercise apparatus according to an embodiment of the present invention.

FIG. 1 is a perspective view illustrating a multi-purpose exercise apparatus according to an embodiment of the present invention. FIG. 2 is an exploded perspective view illustrating a multi-purpose exercise apparatus according to an embodiment of the present invention. FIG. 3 is a rear perspective view illustrating a multi-purpose exercise apparatus according to an embodiment of the present invention. FIG. 4 is a rear perspective view illustrating pivotably-retractable wheels retracted in a multi-purpose exercise apparatus according to an embodiment of the present invention. FIG. 5 is an exploded perspective view illustrating a plurality of grips of a multi-purpose exercise apparatus according to an embodiment of the present invention. FIG. 6 is an exploded perspective view illustrating an elastic stopper detachably inserted into a fixing hole of a multi-purpose exercise apparatus according to an embodiment of the present invention. FIG. 7 is a view illustrating exemplary exercise using a convex surface of a multi-purpose exercise apparatus according to an embodiment of the present invention. FIG. 8 is a view illustrating exemplary exercise using a concave surface of a multi-purpose exercise apparatus according to an embodiment of the present invention.

As shown in FIGS. 1 through 6, the multi-purpose exercise apparatus has a plate shape. An upper portion of the multi-purpose exercise apparatus defines a convex surface 10, and the lower plate thereof defines a concave surface 20 to form a crescent shape. Grip grooves 12 are provided at both end portions of the convex surface 10, respectively. The multi-purpose exercise apparatus has a main body 100 and a grip 200. The main body 100 includes support protrusions 22 integrally formed under the grip grooves 12. Each of the grip 200 is detachably installed at one side of the convex surface 10 of the main body 100.

In this case, each grip 200 is vertically and detachably inserted into a fixing hole 16 that is formed in plurality at both end portions of the convex surface 10 of the main body 100.

Moreover, the grip 200 includes a T-shaped support bar 210 coupled to the fixing hole 16 of the main body 16 and an elastic pad 220 of an elastic material bound to the horizontal bar of the T-shaped support bar 210 and including an elastic material.

In addition, an elastic body 80 is detachably coupled to the fixing hole 16. The elastic body 80 is partially protruded from the fixing hole 16 to prevent the main body from inclining beyond a certain angle when a user does stepper exercise using the convex surface 10. The elastic body 80 is formed of an elastic material capable of absorbing a shock for safety of a user and adjustment of exercise intensity.

In this case, the elastic body 80 is formed of an elastic material such as synthetic resin or rubber. If necessary, the elastic body 80 may include an elastic spring (not shown).

Furthermore, a friction pad 23 is attached to the surface of one end of the support protrusions 22 to prevent sliding of the main body and reduce a shock during exercise.

The main body may be turned over according to exercise methods of a user.

Also, side plates 40 are detachably disposed on both sides of the main body 100, respectively. Each of the side plates 40 is a plate of a crescent shape that matches the curvatures of the convex surface 10 and the concave surface 20. Each of the side plates 40 has a side grip hole 42 formed integrally therewith.

In this case, the side plate 40 is detachably coupled to the main body 100, or is formed integrally with the main body 100 with the side grip hole 42 recessed at both side surfaces of the main body 100.

Furthermore, as shown in FIGS. 1 and 2, support rails 14 are provided in the convex surface 10. The support rails 14 may prevent the convex surface 10 of the main body 100 from being damaged by friction caused by contact with the ground and may reduce a contact area with the ground. Accordingly, the support rails 14 are integrally protruded in plurality to minimize a vibration caused by a surface contact with foreign substances on the ground. Also, the plurality of support rails 14 are spaced apart from each other by a certain distance along the longitudinal direction of the convex surface 10.

In this case, a shock-absorbing pad **14*a* for absorbing a shock from the ground is preferably attached to the upper portion of the support rails 14. The shock-absorbing pad 14*a*** may be formed of an elastic material.

Receiving holes 24 are provided at corresponding edge portions of the concave surface 20 of the main body 100 to receive pivotably-retractable wheels 34, respectively. In this case, each of the pivotably-retractable wheel 34 is received in the receiving hole 24 or is extended outwards via a hinge (not shown).

The hinge (not shown) is provided in the central portion of the receiving hole 24. The pivotably-retractable wheel 34 is formed to have a size ½ times smaller than that of the receiving hole 24 so as not to be interfered with the receiving hole 24 when the pivotably-retractable wheel 34 retracts into the receiving hole 24 and extends outwards.

A stopping protrusion 24*a* is integrally formed in the receiving hole 24 to allow the pivotably-retractable wheel 34 to be elastically fixed when the pivotably-retractable wheel 34 extends outwards. Also, a stopping hole 34*a* is formed in the pivotably-retractable wheel 34 to allow the stopping protrusion 24*a* to be coupled to the stopping hole 34*a*.

The pivotably-retractable wheels 34 are configured to allow the main body 100 to move in forward and backward directions, and if necessary, may be configured to allow the main body 100 to move in all directions.

A rotation disc 60 is provided on the center of the concave surface 20 of the main body 100 to allow a user to step or sit thereon for exercise of the upper part of the body.

In this case, shock-absorbing friction pads 62 formed of an elastic material may be provided on the rotation disc 60 to prevent a foot and a hip from sliding due to rotation during exercise of the upper part of the body and mitigate a shock by the weight of a user.

As shown in FIGS. 3 and 4, acupressure protrusions 25 and acupressure magnet protrusions 27 are protrusively disposed on the concave surface 20 of the main body 100 to perform an acupressure treatment and promote blood circulation.

The acupressure protrusions 25 and the acupressure magnet protrusions 27 are evenly distributed between the rotation disc 60 on the center of the concave surface 20 and the support protrusions 22.

When a user does exercise using the concave surface 20 of the main body 100, the acupressure protrusions 25 and the acupressure magnet protrusions 27 may perform an acupressure treatment on the feet of a user and simultaneously promote blood circulation, by allowing both feet of a user to step on the acupressure protrusions 25 and the acupressure magnet protrusions 27 across the rotation disc 60.

In this case, the support protrusions 22 may serve to prevent the feet of a user from deviating from the acupressure protrusions 25 and the acupressure magnet protrusions 27 to the outside of the main body 100.

Also, a plurality of coupling holes 26 are formed to penetrate the upper and lower portions of the main body 100 at the side end of the main body 100.

An elastic wire 50 formed of an elastic material of excellent elastic resilience is detachably coupled to each of the coupling hole 26.

The elastic wire 50 includes a belt 54 attached with a hook-and-loop fastener 52 detachably coupled to the coupling hole 26 at one end thereof, and a ring-shaped grip 56 held by the hand of a user at the other end thereof.

Here, the elastic wire 50 is configured to a belt 54 attached with a hook-and-loop fastener 52 detachably coupled to the coupling hole 26 at both ends, respectively. Thus, the elastic wire 50 is held by both hands of a user.

On the other hand, a belt 74 is coupled to the coupling hole 26 at one end thereof. The belt 74 is formed of an inelastic material, and is attached with a hook-and-loop fastener 52. The belt 74 may include a tow line 70 with a belt grip 76 integrally formed therewith. When there are two or more users, one user may sit on the convex surface 10 of the main body 100, and the other user may tow the main body 100 with the tow line 70. Accordingly, the multi-purpose exercise apparatus 300 may also be utilized as an amusement ride.

When the tow line 70 is connected to the main body 100, the pivotably-retractable wheels 34 disposed in plurality on the concave surface 20 of the main body is extended outwards.

The present invention configured as described above has the following advantages.

Figure 7A:
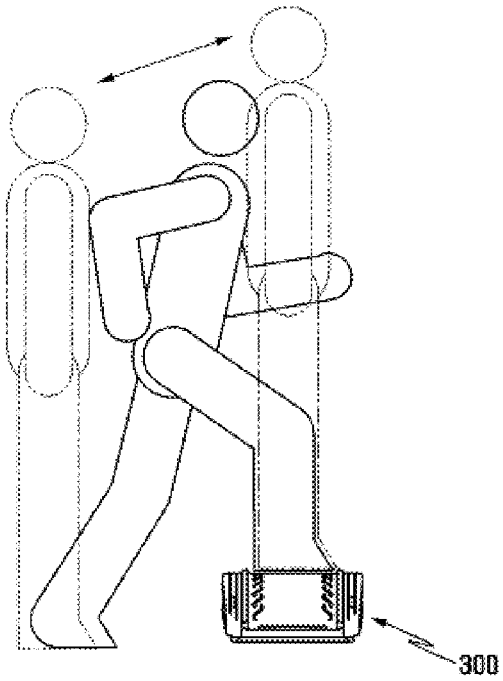
FIG. 7 is a view illustrating exemplary exercise using a convex surface of a multi-purpose exercise apparatus according to an embodiment of the present invention.
Figure 7B:
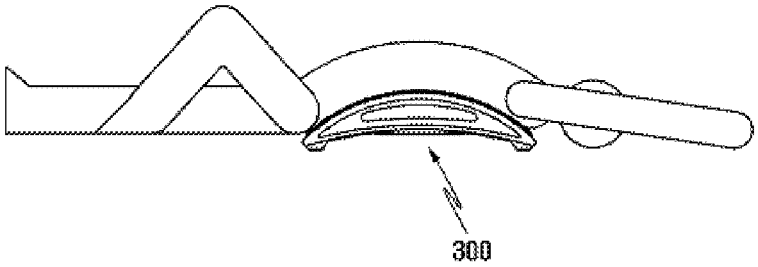

First, exercise methods using the multi-purpose exercise apparatus 300 are largely classified into exercise methods using the convex surface 10 of the main body 100 and exercise methods using the concave surface 10 of the main body 100. FIG. 7 is a view illustrating exemplary exercise using the convex surface 10 of the multi-purpose exercise apparatus according to an embodiment of the present invention. FIG. 8 is a view illustrating exemplary exercise using the concave surface of the multi-purpose exercise apparatus according to an embodiment of the present invention. As shown in FIG. 7A, a user may do exercise for training the lower part of the body by repetitively stepping up and down on the convex surface 10 of the main body 100 of the multi-purpose exercise apparatus 300. As shown in FIG. 7B, a user may stretch his/her legs and arms while lying on the convex surface 10 of the main body 100 with his/her back toward the convex surface 10.

Figure 7C:
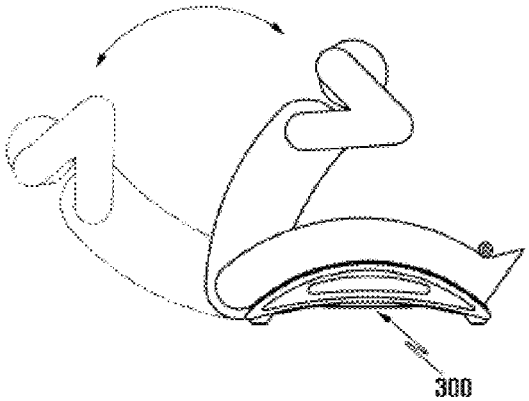

As shown in FIG. 7C, a user may do sit-up exercise to strengthen the abdominal muscle by detachably coupling the grip 200 having a T-shape to the convex surface 10 of the main body 100 and then interposing his/her feet between the grip 200 and the convex surface 10.

On the other hand, FIG. 8 illustrates exercise methods using the concave surface of the multi-purpose exercise apparatus. As shown in FIG. 8A, a user may step on portions of the acupressure protrusions 25 and the acupressure magnet protrusions 27 formed on the concave surface 20 with his/her feet, and may do stepper exercise by walking or running. As shown in FIG. 8B, a user may sit on the rotation disc 60 on the center of the concave surface 20, and then may grip the support protrusions 22 and the grip grooves 12 with his/her hands to do twist exercise of the upper part of the body.

Figure 8A:
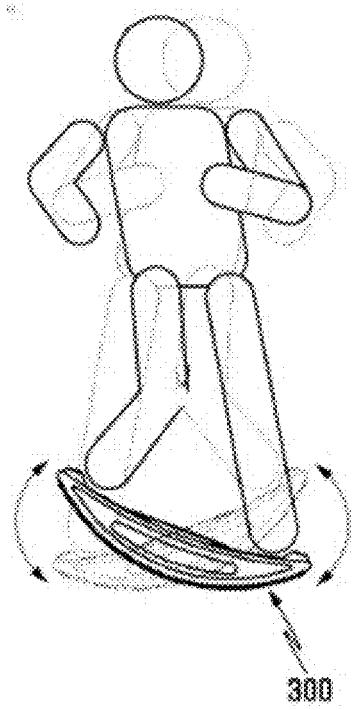
FIG. 8 is a view illustrating exemplary exercise using a concave surface of a multi-purpose exercise apparatus according to an embodiment of the present invention.
Figure 8B:
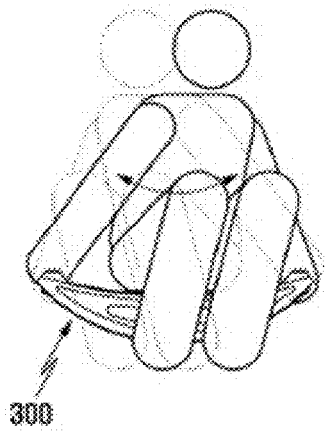
Figure 8C:
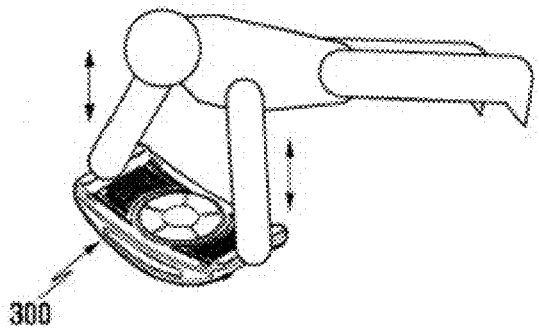

As shown in FIG. 8C, a user may do push-up exercise and exercise for the balance of the whole body by turning the concave surface 20 of the main body 10 upward, holding the support protrusions 22 and the grip grooves 12 of the main body with his/her hands, and stretching his/her waist to balance his/her body.

Figure 8D:
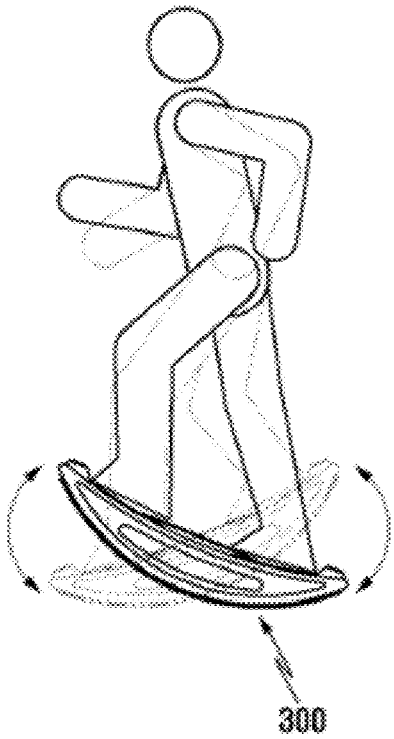

As shown in FIG. 8D, similarly to the exercise method shown in FIG. 8A, a user may do exercise of the lower part of the body by allowing both feet of the user to step on the acupressure protrusion 25 and the acupressure magnet protrusion 27 in the longitudinal direction of the main body 100 and then performing a repeated walking step.

Figure 8E:
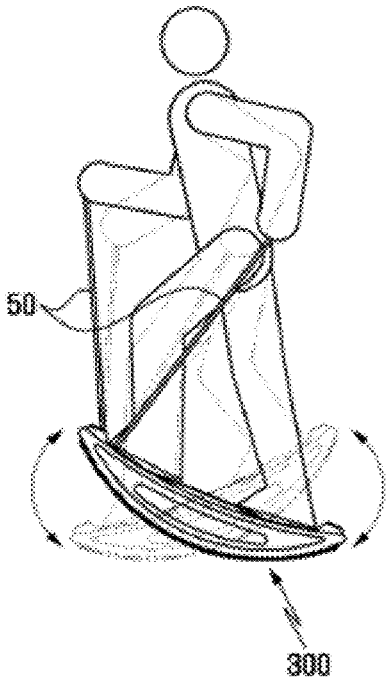

As shown in FIG. 8E, a user may do exercise of the lower part of the body using a walking step in the same posture as that in FIG. 8D. In this case, the user may train both upper and lower parts of the body by doing waling step exercise while holding the elastic wires 50 coupled to the coupling holes 26 with both hands and simultaneously pulling the elastic wires 50 repetitively.

The multi-purpose exercise apparatus 300 is applied to various types of exercise according to users.

To explain exercise methods that are not shown in the accompanying drawing, the multi-purpose exercise apparatus 300 is used for yoga, training of sense of balance, and calf stretching. In the case of yoga, a user may step on the convex surface 10 of the main body 100 and then balance on one leg to pose for yoga and balance sense training.

As described above, the multi-purpose exercise apparatus according to an embodiment of the present invention, which is for a user who does not have time for exercise for health due to a busy schedule, enables the user to do exercise of the whole body regardless of time and space at home without doing exercise in a place such as fitness club including exercise apparatuses at a high cost Also, since a multi-purpose exercise apparatus according to an embodiment of the present invention can roll on the ground via pivotably-retractable wheels, the multi-purpose exercise apparatus can be used as an amusement ride by allowing one user to be seated on a main body thereof and the other user to tow the main body thereof with a tow line connected to the main body thereof.

The embodiments described above are provided for illustration purposes only, and the person skilled in the art would appreciate that various modifications and equivalent embodiments are possible therefrom.

While the present invention has been described with reference to the particular illustrative embodiment, it is not to be restricted by the above embodiment but only by the appended claims.

The invention claimed is:

1. A multi-purpose exercise apparatus comprising:

a main body having a crescent profile, the main body having a convex surface on an upper portion thereof, a concave surface on a lower portion thereof, first and second sides, and first and second end portions, the first and second end portions each comprising a grip groove and a support protrusion integrally formed under the grip groove; and a grip detachably disposed on the convex surface of the main body at one of the first and second end portions, wherein the main body has a plurality of receiving holes for receiving pivotably-retractable wheels at edge portions of the concave surface and the pivotably-retractable wheels are pivoted into the receiving holes on a hinge or are extended outwards.

2. The multi-purpose exercise apparatus of claim 1, wherein the main body comprises sideplates that are integrally disposed at each of the first and second sides of the main body, respectively, and each of the side plates has a shape corresponding to curvatures of the convex surface and the concave surface and has a side grip hole that is integrally formed at an inner side of the side plate.

3. The multi-purpose exercise apparatus of claim 1, wherein the main body has at least one fixing hole at each of the first and second end portions of the convex surface thereof to allow the grip to be detachably coupled thereto.

4. The multi-purpose exercise apparatus of claim 1, wherein the main body has a plurality of coupling holes penetrating the convex surface and the concave surface of the main body at the first and second sides thereof, and the plurality of coupling holes are detachably coupled with elastic wires formed of an elastic material.

5. The multi-purpose exercise apparatus of claim 1, further comprising a plurality of support rails disposed in the longitudinal direction on the convex surface of the main body, the plurality of support rails being spaced apart from each other by a certain distance and being integrally protruded from the convex surface of the main body.

6. The multi-purpose exercise apparatus of claim 1, further comprising friction pads on the support protrusions to prevent sliding of the main body on the ground and reduce a shock during exercise.

7. The multi-purpose exercise apparatus of claim 1, further comprising stopping protrusions integrally formed in the receiving holes to allow the pivotably-retractable wheels to be elastically fixed when the pivotably-retractable wheels extend outwards, and stopping holes formed in the pivotably-retractable wheels to allow the stopping protrusions to be coupled to the stopping holes.

8. The multi-purpose exercise apparatus of claim 1, further comprising a plurality of acupressure protrusions for performing an acupressure treatment on the feet of a user and a plurality of acupressure magnet protrusions for performing the acupressure treatment and promoting blood circulation, disposed on the concave surface of the main body.

9. A multi-purpose exercise apparatus comprising:

a main body having a crescent profile, the main body having a convex surface on an upper portion thereof, a concave surface on a lower portion thereof, first and second sides, and first and second end portions, the first and second end portions each comprising a grip groove and a support protrusion integrally formed under the grip groove;

a fixing hole disposed on the convex surface of the main body at one of the first and second end portions for attachment of a grip or an elastic body;

a grip detachably attachable to the fixing hole; and an elastic body detachably attachable to the fixing hole, when attached, the elastic body being partially protruded from the fixing hole to prevent the main body from inclining beyond a certain angle when a user does stepper exercise using the convex surface, and wherein the elastic body is formed of an elastic material capable of absorbing a shock for safety of a user and adjustment of exercise intensity.

10. A multi-purpose exercise apparatus comprising:

a main body having a crescent profile, the main body having a convex surface on an upper portion thereof, a concave surface on a lower portion thereof, first and second sides, and first and second end portions, the first and second end portions each comprising a grip groove and a support protrusion integrally formed under the grip groove;

a grip detachably disposed on the convex surface of the main body at one of the first and second end portions; and a rotation disc at the center of the concave surface of the main body to allow a user to step or sit thereon for exercise of the upper part of the body.

* * * * *